United States Patent [19]

Naess et al.

[11] 4,145,097

[45] Mar. 20, 1979

[54] DATA TERMINAL DESK

[76] Inventors: Ture P. A. Naess, Grankärr, S-560 30 Gränna; Sven G. V. Larsson, Skogsvägen 37, S-560 28 Lekeryd, both of Sweden

[21] Appl. No.: 857,618

[22] Filed: Dec. 5, 1977

[30] Foreign Application Priority Data

Dec. 6, 1976 [SE] Sweden ..... 7613636

[51] Int. Cl.[2] ..... A47B 37/00

[52] U.S. Cl. ..... 312/196; 312/29; 312/208

[58] Field of Search ..... 312/196, 208, 28, 29, 312/21, 273

[56] References Cited

U.S. PATENT DOCUMENTS

| | | | |
|---|---|---|---|
| 670,370 | 3/1901 | Dewhurst | 312/29 |
| 1,731,696 | 10/1929 | Erskine | 312/196 |
| 2,155,293 | 4/1939 | Bargen | 312/29 |
| 3,321,257 | 5/1967 | Carlson | 312/196 |
| 3,778,125 | 12/1973 | Guttmann, Jr. et al. | 312/196 |

FOREIGN PATENT DOCUMENTS

| | | | |
|---|---|---|---|
| 578683 | 10/1924 | France | 312/29 |

*Primary Examiner*—Mervin Stein
*Assistant Examiner*—Alex Grosz
*Attorney, Agent, or Firm*—Holman & Stern

[57] ABSTRACT

A data terminal for use with a viewing screen and comprising a holder for a keyboard, the holder being slidable in a direction perpendicular to a back of the desk between a working position with the keyboard holder in a recess in a front part of a desk top of the desk and a rest position with the keyboard holder closer to the back and beneath the desk top; a removable cover covering the recess in the rest position and removable from the rest position of the keyboard holder covered by a removable flap and through which opening the keyboard is operationally accessible in the rest position thereby leaving a substantial portion of the desk top clear for working space.

2 Claims, 8 Drawing Figures

DATA TERMINAL DESK

The present invention relates to data terminal work positions and in particular to data terminal desks provided with viewing screen and keyboard which may be used there. In the case of hitherto existing work positions of this type the keyboard and viewing screen have been firmly fixed and often on different tables or the data terminal operator has had at his disposal an ordinary desk and an extra additional table provided with a viewing screen and keyboard, which has the disadvantage that the operator has had to change places in passing from pure desk work to work with the keyboard and the viewing screen. The viewing screen and the keyboard have furthermore not been able to be positioned most advantageously for the work, as they have been in the way for ordinary desk work.

An object of the invention is to avoid the above-mentioned disadvantages and to provide a data terminal desk at which all the existing operations may be undertaken without the operator having to change his place. The invention, the characteristic feature of which is set out in the following patent claims, is described in greater detail below in connection with the enclosed drawings, in which:

Figure 2:
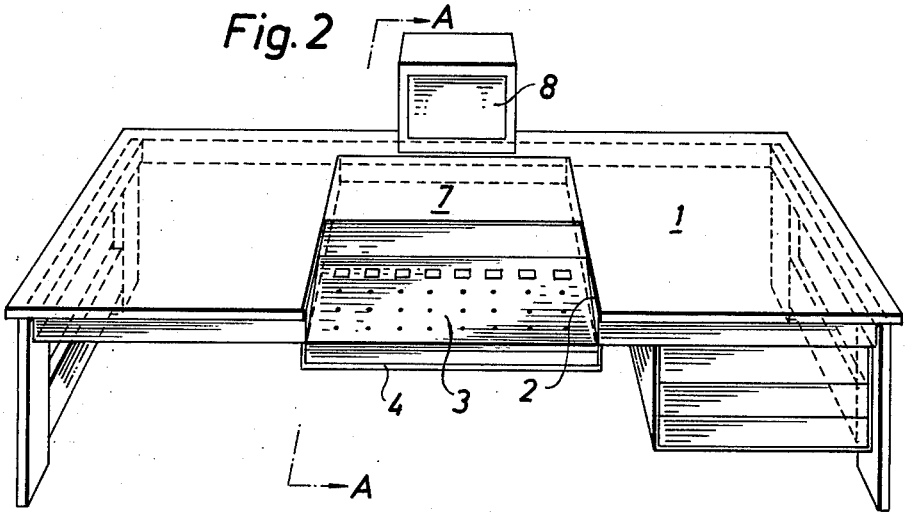
FIG. 2 shows a somewhat modified embodiment of the data terminal desk.
Figure 3:
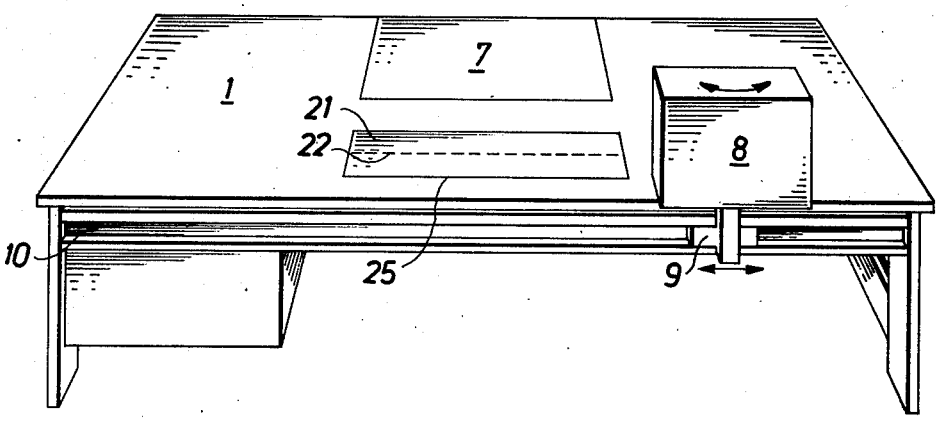
Figure 4:
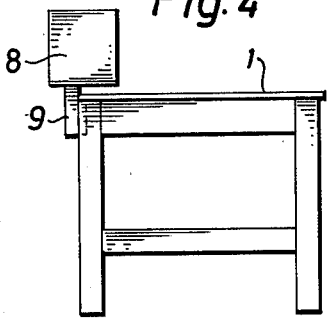
Figure 5:
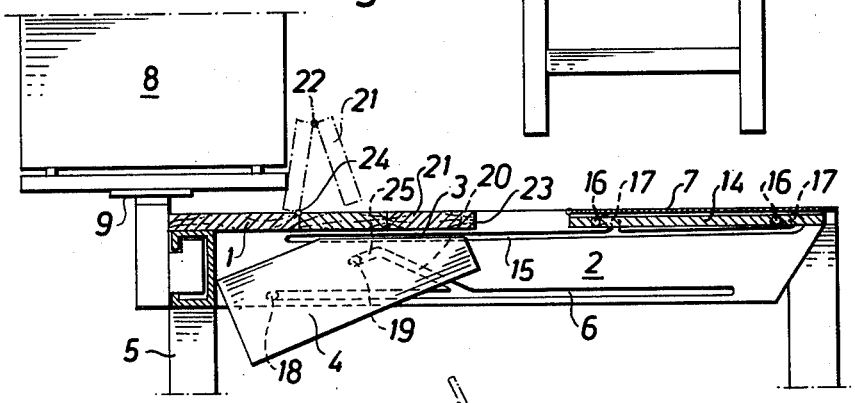
Figure 6:
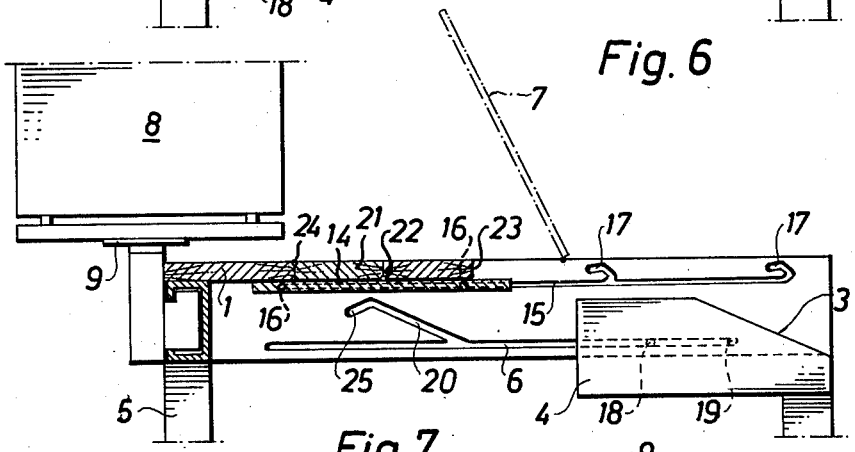
Figure 7:
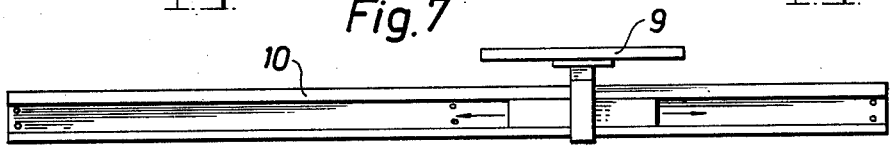
Figure 8:
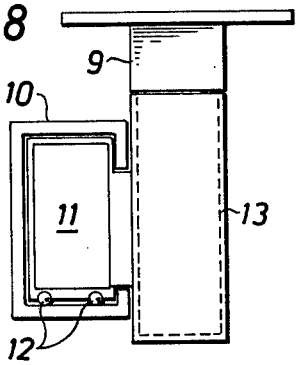

FIG. 3 likewise shows in perspective the data terminal desk seen from behind and with the viewing screen and the keyboard in a rest position;

FIG. 4 shows the data terminal desk seen from the right of FIG. 3;

FIGS. 5 and 6 show a section along the line A—A in FIG. 2 and with the viewing screen and the keyboard in the rest and the working position respectively;

FIG. 7 shows, seen from behind in FIG. 3 and on a larger scale, a guide track device for the viewing screen, and FIG. 8 is a view on a still larger scale of the guide track device seen from the right of FIG. 7.

Figure 1:
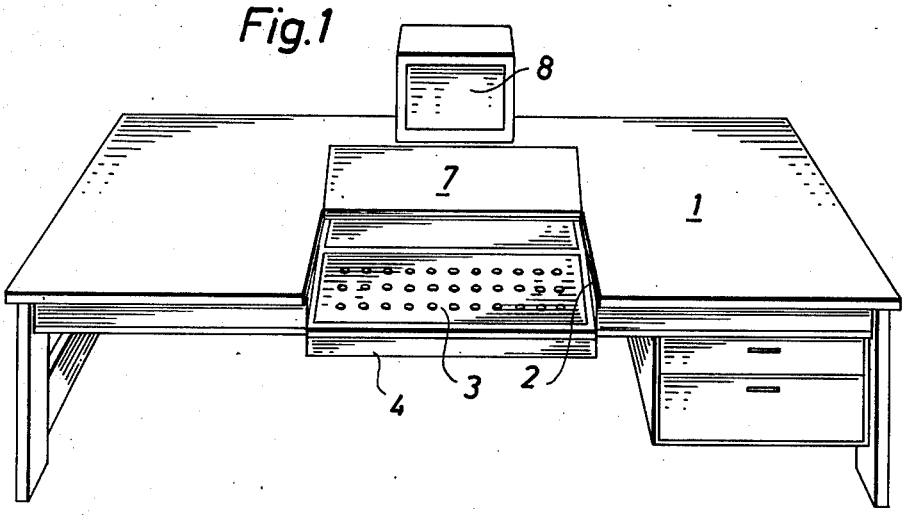
FIG. 1 shows schematically and in perspective a data terminal desk according to the invention seen from the front, and in a working position.

The desk top 1 of the data terminal desk shown in FIG. 1 has a recess 2 for a keyboard 3, lowered for a convenient working position and belonging to the data terminal apparatus, in front of the position for a data terminal operator. This keyboard is disposed in a case or other holder 4 which is slidable in a direction perpendicular to the back 5 of the desk along guides 6 shown in FIGS. 5 and 6 from the working position shown in FIGS. 1 and 6 to a rest position shown in FIG. 5, in which rest position the keyboard is disposed closer to the back of the desk and beneath the desk top 1. A cover 7 is disposed so that it may be swung up about an axis parallel to the front and back of the desk from a position covering a recess and into the raised position shown in FIG. 1 and confined by means of stop devices not shown, in which position the cover leans backwards somewhat and can function as a support or rest for folders or loose papers. In the first-mentioned position illustrated in FIG. 3 the surface of the cover is disposed at the same level as the surface of the desk generally and then the desk can be used as an ordinary writing desk.

The screen 8 belonging to the data terminal apparatus is supported on a stand 9 which is slidable along a guide track 10 disposed on the back 5 of the desk from a rest position at one end of the back to a working position shown in FIGS. 1 and 2 in front of the recess 2 and the data terminal operator's work position. The stand with the viewing screen can possibly be slid further towards the other end of the desk. FIGS. 7 and 8 show the stand and the guide track in greater detail. FIG. 8 shows how a guide device 11 introduced from the stand into the guide track U-shaped in section can be slidably mounted by means of a ball bearing device 12. This may consist of straight tracks for the balls on the bottom part of the guide device and return channels for the balls through the guide device. The stand 9 can be rotatably mounted by means of a vertical bearing 13 in the guide device so that the data terminal operator can rotate the viewing screen to a convenient position of rotation.

The viewing screen stand 9 and the slidable holder 4 for the keyboard 3 may be so connected by way of a transmission movement not shown which forcibly brings the viewing screen stand from its rest position to the working position at the same time as the holder for the keyboard is brought from its rest position to the working position and vice versa. Such a transmission movement can be carried out by a wire drawn over suitable pulleys, possibly supported by springs.

The cover 7 may be replaced or supplemented by a lid 14 shown in FIGS. 5 and 6 which is slidable along slide channels 15 disposed on the sides of the recess 2, pins 16 disposed in the edges of the lid engaging in said slide channels. The slide channels, which extend beneath the desk top 1 towards the back of the desk, have two end channels 17 turning upwards and backwards in front of the recess 2 and at a distance from one another corresponding to the distance between the pins 16. In the rest position of the lid shown in FIG. 5 the latter has been pushed upwards somewhat by means of a spring device not shown so that the pins have entered the above-mentioned slide channels, the lid covering the recess and being disposed on a level with the surface of the desk top of the desk. Should there also be a cover 7, not shown in FIGS. 5 and 6, the lid must naturally be located beneath the said cover in the rest position. The lid remains fixed in the rest position owing to its end portions leaning downwards and backwards.

For the sake of clarity the lid 14 has been shaded with vertical strokes in FIGS. 5 and 6.

By pulling the lid away from himself somewhat and pressing it down into the slide channels against the action of the above-mentioned spring device and by pushing the lid away from himself the data terminal operator can slide the lid from the rest position to its working position shown in FIG. 6, in which it is disposed beneath the desk top and close to the back of the desk while it leaves the recess 2 open for the keyboard 3.

As mentioned above the holder 4 of the keyboard 3 is slidable along the guides 6 by pins 18 and 19 projecting from the sides of the holder entering these guides. In the working position shown in FIG. 6 the keyboard occupies a position leaning forwards that is adjusted for the data terminal operator. As the keyboard has been pushed backwards towards its rest position shown in FIG. 5 closer to the back of the desk, the two front pins 19 enter end grooves 20 directed upwards from the guides and causing the holder of the keyboard to lean backwards so that the keyboard comes to occupy the position shown in FIG. 5 parallel to the desktop 1 directly under the desk top. In this case the desk top can have a removable flap 21, divided into two portions by means of hinges 22 in the case shown, in an opening 23 through the desk top. By swinging the flap up about hinges 24 on the rear edge of the flap, it is possible to uncover the keyboard in the rest position for occasional use without the keyboard having to be slid into its working position. Such an opened position of the flap is indicated by means of broken lines in FIG. 5.

As may be seen in FIGS. 5 and 6 the end grooves 20 may finish in portions 25 bent down somewhat, which provide a certain locking for the keyboard holder in its rest position.

The lid 14 and the holder 4 for the keyboard 3 may be connected by way of a transmission movement not shown, which forcibly co-ordinates the movements of the lid and the holder so that both move at the same time towards their rest position shown in FIG. 5 or their working position shown in FIG. 6 respectively.

Without having to move from his place in front of the recess 2 the data terminal operator can alternately use the desk as such when the keyboard is in the rest position beneath the desk top and the viewing screen is moved out of the way to one end of the back of the desk, and use it as a data terminal after having uncovered the recess 2 with some simple manipulations and moved the keyboard to the working position at the same time as the viewing screen has been slid into its working position in front of the operator.

The data terminal desk according to the invention may be modified within the scope of the following patent claims.

We claim:

1. A data terminal desk comprising a slidable screen and a holder for a keyboard, said holder being slidable in a direction perpendicular to a back of the desk between a working position with the keyboard holder in a recess in a front part of the desk top of the desk and a rest position with the keyboard holder and keyboard closer to the back and totally beneath the desk top; a removable cover covering the recess in the rest position and removable from the recess; an opening in the desk top in the front of the rest position of the keyboard holder covered by a removable flap and through which opening the keyboard is operationally accessible in the rest position, said keyboard and holder being in an inclined attitude, thereby leaving a substantial portion of the desk top clear for working space; said slidable viewing screen being slidably mounted on the back of the desk for movement therealong.

2. A data terminal desk according to claim 1, wherein the removable cover for the recess may be swung up about an axis in the rear part of the recess parallel to the front and back of the desk.

* * * * *